US006678661B1

(12) United States Patent
Smith et al.

(10) Patent No.: US 6,678,661 B1
(45) Date of Patent: Jan. 13, 2004

(54) METHOD AND SYSTEM OF AUDIO HIGHLIGHTING DURING AUDIO EDIT FUNCTIONS

(75) Inventors: Gordon James Smith, Rochester, MN (US); George Willard Van Leeuwen, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/502,881

(22) Filed: Feb. 11, 2000

(51) Int. Cl.[7] ..... G10L 21/02
(52) U.S. Cl. ..... 704/278; 704/276
(58) Field of Search ..... 704/278, 270, 704/270.1, 276

(56) References Cited

U.S. PATENT DOCUMENTS 4,618,895 A 10/1986 Wright
5,204,969 A * 4/1993 Capps et al. ..... 704/278
5,613,056 A * 3/1997 Gasper et al. ..... 345/473

* cited by examiner

*Primary Examiner*—Richemond Dorvil
*Assistant Examiner*—Donald L. Storm
(74) *Attorney, Agent, or Firm*—Bracewell & Patterson, LLP; Roy W. Truelson

(57) ABSTRACT

A method for highlighting a desired portion in an audio sequence for use in a visual display challenged environment. The method includes storing the audio sequence in memory. Next, the user selects a desired portion of the audio sequence and the selected portion is distinguished from the remainder of the audio sequence by automatically varying an audio characteristic of the selected portion during playback, without permanently altering the selected portion. In a related embodiment, the audio characteristic that is varied is pitch of the selected portion.

18 Claims, 3 Drawing Sheets

METHOD AND SYSTEM OF AUDIO HIGHLIGHTING DURING AUDIO EDIT FUNCTIONS

BACKGROUND OF THE INVENTION

1. Technical Field

The present invention relates generally to audio signal processing and in particular to the editing of audio signals. Still more particularly, the present invention relates to a method and system for generating and processing efficient audio edit functions.

2. Description of the Related Art

Audio data processing has increasingly moved from the traditional specialized, and more expensive, audio processing equipment into the desktop computing environment, thus allowing a user more flexibility in audio data management. Audio data, in the form of analog signals stored on a flexible tape, such as a magnetic tape, or, alternatively, in a digital format stored in a computer's memory or hard drive can be retrieved from these storage mediums by a computer system and played through an internal, or attached, speaker. Audio software control routines and computer programs typically residing on a desktop computer act to control, through a user interface, the interaction of the user and the audio data desired for playback and manipulation. Specialized menus and graphical user interfaces facilitate easy access and manipulation of previous stored audio data using, for example, a mouse and a display screen, such as a monitor. Presently, audio data is utilized in desktop computer systems in a variety of ways and for a variety of functions. For example, audio voice data may be used for recording dialog sessions, such as for leaving instructions to a secretary or assistant. In a different application, audio data located by displayable "tags" may be placed within a text document with specific instructions to amend the text document when the tag is activated by a user pointing device, e.g., a mouse. Audio data may be used to record meeting information and instructions for later playback. In the realm of e-mail, audio data may be effectively utilized as a means for electronic mail, instead of text.

Computer systems provide a unique and versatile platform for interfacing with voice data systems. Unlike conventional audio data storage media, such as audio tape or tape cassette, the audio data is typically stored in a computer's memory, e.g., random access memory (RAM) or a disk drive. This provides a user a means for quick and easy access to any audio segment within the stored audio data as opposed to, e.g., a regular cassette tape that requires cycling through any preceding tape segments in a serial manner before arriving at the desired segment.

It is often necessary, for example, to identify where a particular audio clip, or segment, is located in an otherwise continuous and uneventful audio stream. While this is presently accomplished utilizing visual aids that include video highlighting combined with conventional cut, copy and paste operations, there are numerous situations that are evolving in our increasingly connected world where this is not possible or is much too cumbersome for use, e.g., on a handheld computer or cell phone with their limited size display screens. Communication and computing devices are ever reducing in size without sacrificing computing or processing power. These smaller devices with their associated very small display screens are fast becoming more common and may soon be more numerous than their larger counterparts. Additionally, voice-activated systems are increasingly utilized, e.g., in the transportation environment, such as passenger automobiles, where a driver's attention should be focused on oncoming traffic as opposed to trying to manipulate an on-board computer or telephone, for obvious safety reasons. Other areas where conventional audio editing systems are limiting include public transportation, such as taxis and police vehicles. Within these environments, e.g., smaller devices with smaller screens and where no visual displays are present, the use of conventional audio editing systems are severely limited or precluded.

Accordingly, what is needed in the art is an improved method for editing audio data that mitigates the above discussed limitations. More particularly, what is needed in the art is a audio editing system that eliminates the need for visual editing aids.

SUMMARY OF THE INVENTION

It is therefore an object of the present invention to provide an improved method for editing audio signals.

It is another object of the present invention to provide a method and system for generating and processing efficient audio edit functions.

To achieve the foregoing objects, and in accordance with the invention as embodied and broadly described herein, a method for highlighting a desired portion in an audio sequence for use in a visual display challenged environment is disclosed. The method includes storing the audio sequence in memory. Next, a desired portion of the audio sequence is selected and the selected portion is distinguished from the remainder of the audio sequence by varying an audio characteristic of the selected portion. In a related embodiment, the audio characteristic that is varied is a pitch of the selected portion. Alternatively, the "markers" distinguishing the selected portion from the remainder of the audio sequence may be buzzers, bells and the like. Additionally, these markers may also be utilized at frequencies above or below human hearing so that they may be hidden.

The present invention introduces a novel method for generating and processing a "cursor," or highlight, for use in an audio processing system. The present invention specifically addresses the current problems encountered in environments wherein visual displays for displaying a representation of audio data, allowing for the locating and manipulating of segments within the audio data, are severely limited in screen size or non-existent. The present invention, unlike conventional techniques that utilize visual aids, distinguishes selected portions within the audio data by varying an audio characteristic of the selected portion precluding the need for a visual representation of the audio data.

In one embodiment of the present invention, distinguishing the selected portion of the audio sequence from the rest of the audio sequence includes re-sampling the selected portion of the audio sequence to vary the pitch of the selected portion of the audio sequence. In a related embodiment, selecting a portion from the rest of the audio sequence includes utilizing start and end edit pointers to delimit the boundaries of the selected portion. Alternatively, in other advantageous embodiments, distinguishing the selected portion from the rest of the audio sequence may include increasing or decreasing the volume level in the selected portion by attenuating or amplifying the desired portion in the audio sequence. It should be noted that the above mentioned schemes for distinguishing the selected portion of the audio sequence are merely illustrative, the present invention does not contemplate limiting its practice to any one scheme.

In another embodiment of the present invention, the method further includes performing an editing operation on the selected portion of the audio sequence. The editing operations includes, in advantageous embodiments, removing the selected portion from the audio sequence and locating the selected portion from a first location to a second location in the audio sequence. It should be noted that the editing operations described above are merely illustrative and that the present invention does not contemplate limiting its practice to any set number of editing functions.

The foregoing description has outlined, rather broadly, preferred and alternative features of the present invention so that those skilled in the art may better understand the detailed description of the invention that follows. Additional features of the invention will be described hereinafter that form the subject matter of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION OF ILLUSTRATIVE EMBODIMENT

Figure 1:
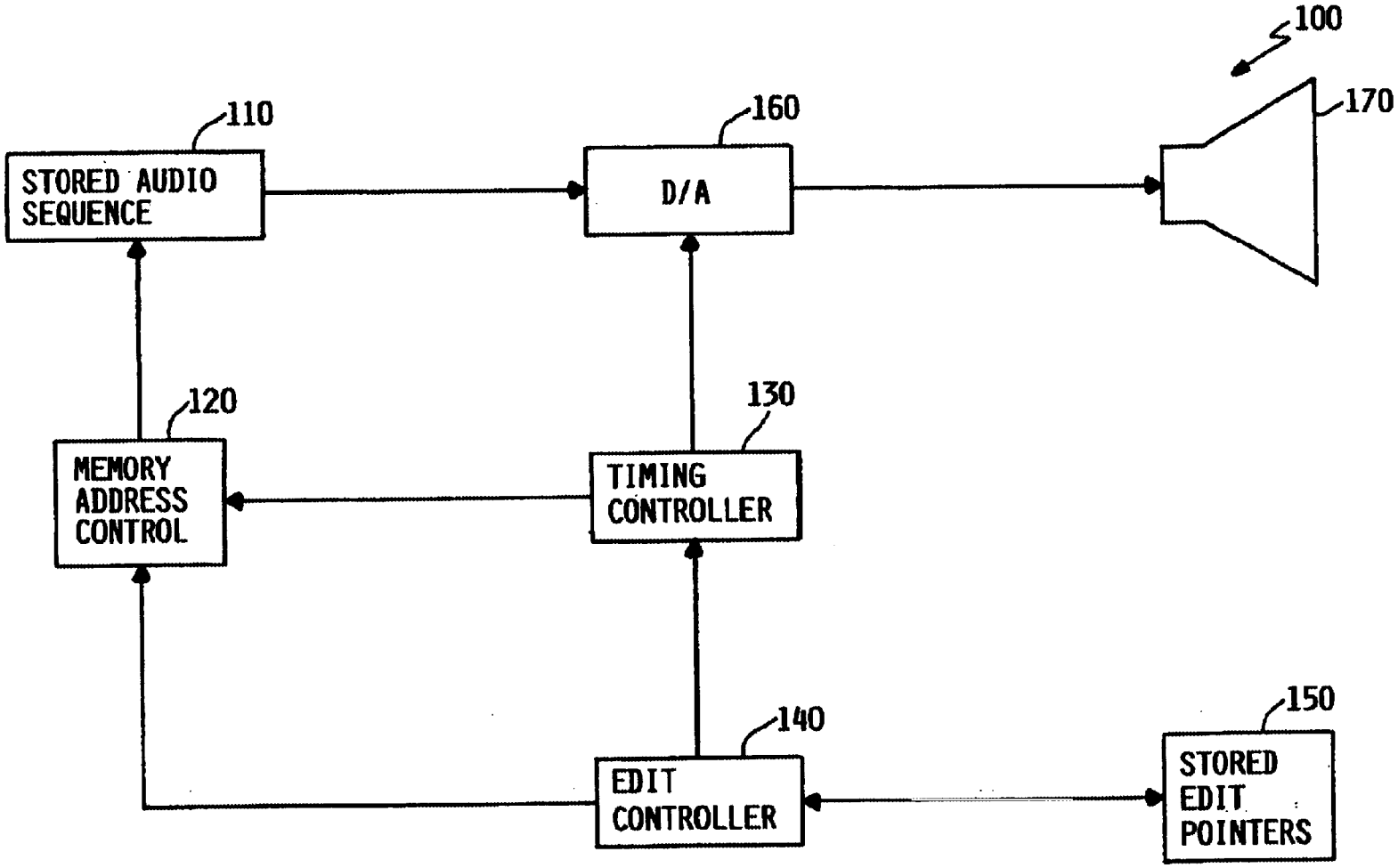
FIG. 1 illustrates an embodiment of an audio editing system constructed according to the principles disclosed by the present invention.

With reference now to the figures, and in particular, with reference to FIG. 1, there is depicted an embodiment of an audio editing system 100 constructed according to the principles disclosed by the present invention. Audio editing system 100 includes a memory 110 for storing an audio sequence comprising digital audio data. The stored audio sequence in memory 110 is accessed/located utilizing a memory address control 120 that, in a preferred embodiment, is a counter. The rate at which the addresses in memory 110 are accessed is controlled by a timing controller 130 that, in an advantageous embodiment, is adjustable. Timing controller 130, in turn, is controlled by an edit controller 140 that has locally stored pointers 150 that, in an advantageous embodiment, are stored as a table registry in a conventional memory device, such as a disk drive. Stored pointers 150 identify the memory addresses of the corresponding to "begin" and "end" edit pointers of selected portions within the stored audio sequence residing in memory 110. Audio editing system 100 further includes a digital-to-analog converter 160, coupled to timing controller 130, that converts the stored digital audio data into an analog audio signal that is then amplified and broadcast utilizing a conventional amplifier and speaker 170.

Allowing timing controller 130 to adjust the rate at which the stored audio sequence is re-sampled permits altering the pitch of selected portions of the stored audio sequence during playback. When the reproducing speed, i.e., the speed at which audio signals recorded on a recording medium are reproduced, is changed with respect to the original recording speed, i.e., the speed at which the audio signals were previously recorded on the recording medium, not only is the reproducing speed or tempo but also the sound pitch or key is changed. That is, the higher, or faster, the reproducing speed, the higher is the resulting sound pitch and, conversely, the slower the reproducing speed, the lower is the resulting sound pitch.

Changing the pitch of the selected portions of the reproduced audio signal may be accomplished in variety of ways. For example, analog delay devices, such as bucket brigade devices or charge coupled devices, may be utilized and the read or write clock signals thereof are chronologically altered for controlling the delay time. Alternatively, in the digital world, digital delay elements, such as shift registers, may be employed for effecting time base compression or expansion through control of the writing and read-out operations.

In the foregoing discussion and illustrated embodiment, distinguishing the selected portions from the rest of the stored audio sequence has been described in the context of varying the pitch of the selected portions. Those skilled in the art should readily appreciate that, in other advantageous embodiments, distinguishing the selected portions may also be accomplished by raising or lowering the volume of the selected portions. Alternatively, sound effects, such as reverberation, delay, flanging, overlay mixed with a single tone, etc., may also be added to the selected portions to distinguish them from the rest of the audio sequence. The present invention does not contemplate limiting its practice to any one particular methodology.

Figure 2:
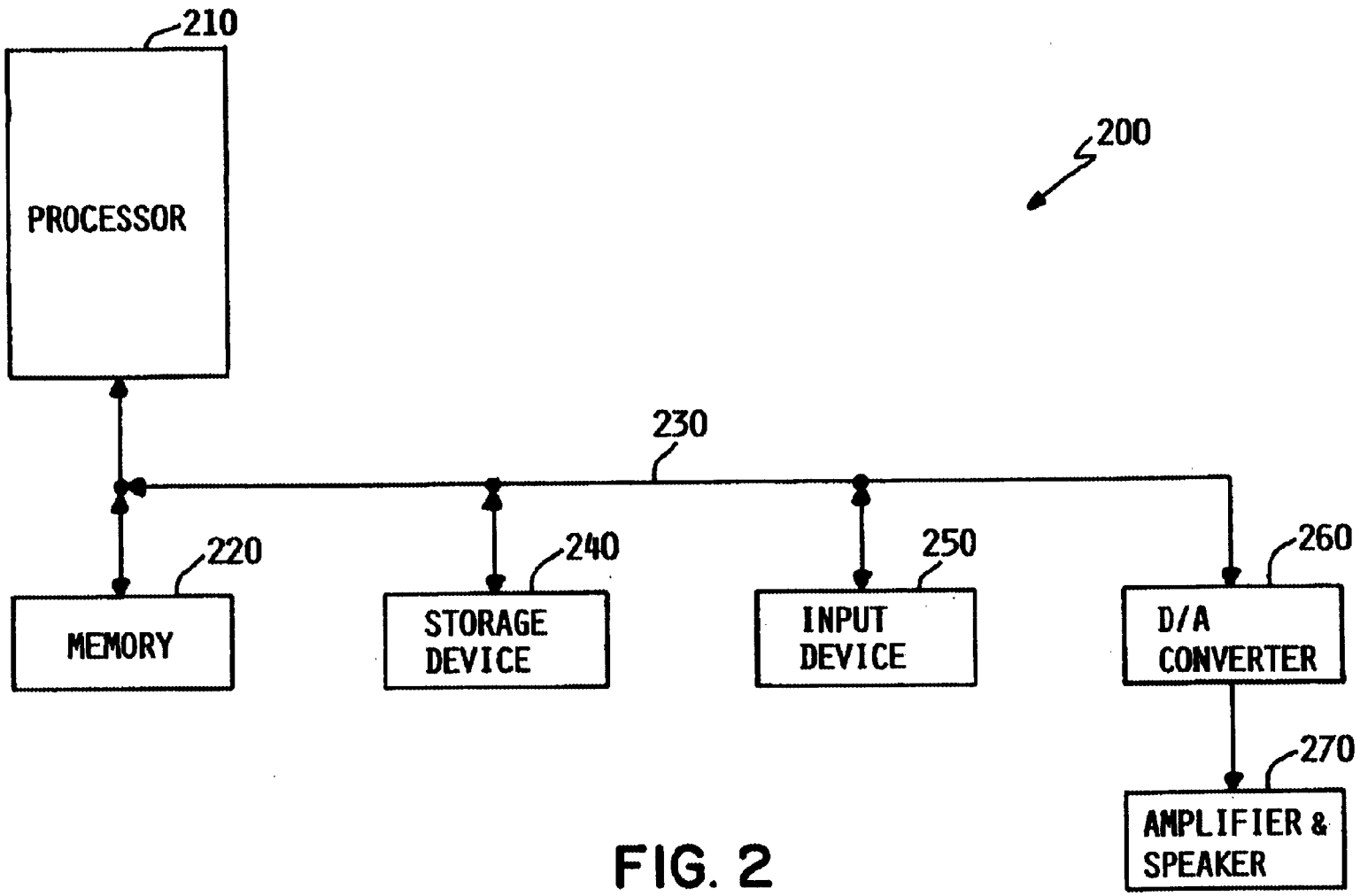
FIG. 2 illustrates an embodiment of a processing system that provides a suitable processing environment for the practice of the present invention.

Referring now to FIG. 2, there is illustrated an embodiment of a processing system 200 that provides a suitable processing environment for the practice of the present invention. Processing system 200, in an advantageous embodiment, is embodied in a personal computer (PC) manufactured by IBM Corporation of Armonk, N.Y. It should also be readily apparent to those skilled in the art, however, that alternative computer system architectures may also be employed. Generally, processing system 200 includes a bus 230 for communicating information, a processor 210 coupled to bus 230 for processing information, a memory 220 coupled to bus 215 for storing information and instructions for processor 210, an input device 250, such as mouse, button or an interface to a conventional voice recognition system, coupled to bus 230 for communicating information and command selections to processor 210 and a data storage device 240, such as a magnetic disk and associated disk drive, coupled to bus 230 for storing information and instructions. Processing system 200 also includes a conventional digital to analog (D/A) converter that provides an analog signal to an amplifier and speaker system 270 for broadcasting stored audio data.

Processor 210 may be any of a wide variety of general purpose processors or microprocessors, such as the i486™ or Pentium™ brand microprocessor manufactured by Intel Corporation of Santa Clara, Calif. However, it should be apparent to those skilled in the art that other varieties of processors, such as digital signal processors, may also be advantageously utilized in processing system 200. Data storage device 240 may be a conventional hard disk drive, floppy disk drive, or other magnetic or optical data storage device for reading and writing information stored on a hard disk drive, floppy disk drive, or other magnetic or optical data storage medium.

In general, processor 210 retrieves processing instructions and data from data storage device 240 and downloads this information into memory 220 for execution. Thereafter, processor 210 then executes an instruction stream from random access memory (not shown) or read only memory (not shown). Command selections and information inputted at input device 250 are used to direct the flow of instructions executed by processor 210. The operation of audio editing system 100 will hereinafter be described in greater detail with reference to FIGS. 3A–3D, with continuing reference to FIG. 1, wherein an exemplary editing operation, i.e., cutting and pasting, is performed.

Figure 3A:
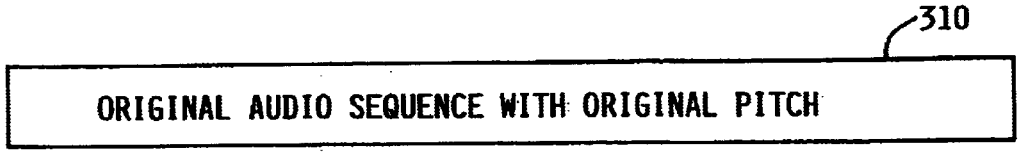
FIG. 3A illustrates an exemplary audio sequence.
Figure 3B:
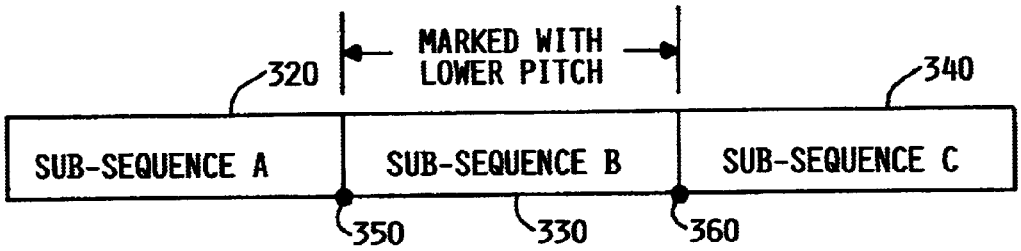
FIG. 3B illustrates three sub-sequences within the audio sequence depicted in FIG. 3A wherein one of the sub-sequences is highlighted utilizing begin and end edit pointers according to the present invention.
Figure 3C:
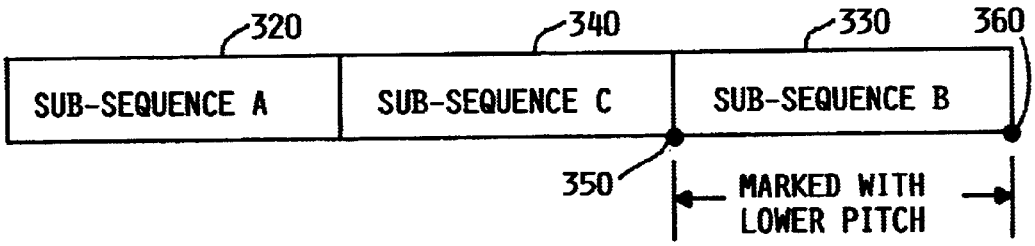
FIG. 3C illustrates a reordering of the sub-sequences within the audio sequence depicted in FIG. 3A.
Figure 3D:
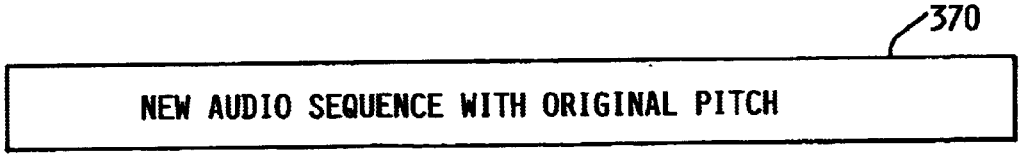
FIG. 3D illustrates a new reconstructed audio sequence.

Referring now to FIGS. 3A–3D, FIG. 3A depicts an exemplary audio sequence 310. FIG. 3B illustrates three sub-sequences within audio sequence 310 wherein one of the sub-sequences is highlighted utilizing begin and end edit pointers 350, 360, respectively, according to the present invention. FIG. 3C depicts a reordering of the sub-sequences within audio sequence 310 and FIG. 3D illustrates a new reconstructed audio sequence 370.

Turning initially to FIG. 3A, an original audio sequence 310, e.g., a conversation or broadcast music, is recorded and stored in digital form in memory 110 generally utilizing a microphone coupled to an analog-to-digital converter that converts the original analog audio signal to digital audio data. It should be noted that the present invention may also be utilized for music such as digital MP3 and other formats. Original audio sequence 310 includes first, second and third sub-sequences 320, 330, 340 and for illustrative purposes, a user would like to reposition second sub-sequence 330 as the last segment in audio sequence 310. To accomplish this, audio sequence 310 is replayed employing D/A converter 160 and amplifier/speaker 170 to broadcast the stored audio sequence. "Begin" and "end" edit pointers 350, 360, respectively, are then utilized to point to the address locations in memory 110 corresponding to the start and end of second sub-sequence 330.

Begin and end edit pointers 350, 360 are assigned by the user designating the desired portion utilizing, in an advantageous embodiment, a voice command to a voice recognition input device (not shown), e.g., a microphone, or, in another alternative embodiment, an input device, such as a button selector. Following the assignment of edit pointers 350, 360 delimiting second sub-sequence 330 from first and third sub-sequences 320, 340, stored audio sequence 310 may be replayed again to verify that the desired portion has been highlighted. During this rebroadcast, timing controller 130 will reduce the rate at which the stored audio portion between begin and end edit pointers 350, 360 are replayed, resulting in second sub-sequence 330 having a lower pitch than first and third sub-sequences 320, 340. Alternatively, the rate at which second sub-sequence 330 is replayed may be increased, resulting in second sub-sequence 330 having a higher pitch.

The variation in the pitch allows the user to be able to distinguish the selected portion, i.e., second sub-sequence 330, from the rest of stored audio sequence 310 without requiring a visual display. Second sub-sequence 330 may then be reordered (cut and paste), as depicted in FIG. 3C, or be removed in its entirety, i.e., delete operation, from stored audio sequence 310 to produce a new audio sequence 370 as shown in FIG. 3D. If reordered audio sequence 370 is played back, the user will hear 35 second sub-sequence 330 near the end of reordered audio sequence 370 rather than in the middle of the audio sequence. Edit pointers 350, 360 may then be removed so that new audio sequence may be heard with the original pitch for all sub-sequences.

To illustrate the practice of the present invention in a real-world environment, consider the following exemplary scenario. John is driving to work and with congested freeway traffic, he must concentrate on the road conditions. Next, during his commute to work, he receives a call on his cell phone from a co-worker already at work. It should also be noted that John is recording this telephone conversation and saving it to an attached audio editing system (of course, John has already notified his co-worker that their conversation is being recorded). The co-worker describes a problem that he is having with a particular product, interposing his complaints about the product with disparaging comments about the product's manufacturer. After discussing the problem with his co-worker, John suggests that it would be a good idea to forward his co-worker's comments verbatim to the manufacturer. Being sensitive to the manufacturer's feelings, John decides not to include the disparaging comments which are part of the recorded conversation.

Utilizing an input device, e.g., a button attached to his steering wheel, or alternatively, a microphone with voice-recognition software, attached to audio editing system 100, John plays back the recorded conversation. Employing edit pointers 150 in audio editing system 100, John marks the beginning and end of each of the offending sections of the recorded conversation, again utilizing the attached input device. John then replays the recorded conversation to verify that the selected sections are highlighted. Edit control 140 changes the play back timing of the selected sections that, in turn, changes the audio pitch of the selected audio segments. Following confirmation that all the selected sections have been highlighted, John then inputs a "delete" command, e.g., via a delete button or a voice command. After verifying that the recorded conversation is now "clean," i.e., all offending comments removed, John proceeds to call the manufacturer and leaves the "censored" message. It should be noted that the marked regions may be either transmitted or not transmitted. If they are transmitted, they may also be marked with a "special" mark, e.g. a strikethrough, to indicate that they will be deleted.

It should be noted that although the present invention has been described, in one embodiment, in the context of a computer system, those skilled in the art will readily appreciate that the present invention is also capable of being distributed as a computer program product in a variety of forms; the present invention does not contemplate limiting its practice to any particular type of signal-bearing media, i.e., computer readable medium, utilized to actually carry out the distribution. Examples of signal-bearing media includes recordable type media, such as floppy disks and hard disk drives, and transmission type media such as digital and analog communication links.

In an advantageous embodiment, the present invention is implemented in a computer system programmed to execute the method described herein. Accordingly, in an advantageous embodiment, sets of instructions for executing the method disclosed herein are resident in RAM of one or more of processors configured generally as described hereinabove. Until required by the computer system, the set of instructions may be stored as computer program product in another computer memory, e.g., a disk drive. In another advantageous embodiment, the computer program product may also be stored at another computer and transmitted to a user's computer system by an internal or external communication network, e.g., LAN or WAN, respectively.

From the foregoing, it is apparent that the present invention provides for audio cursor, highlighting and edit functions that do not necessarily require a keypad, display or pointing device. This is especially advantageous in environments where it is important for a user to concentrate visually on something besides a display monitor, such as during the operation of a motor vehicle. Furthermore, smaller multimedia computing devices, such as handheld or wrist-held computers and the like, with limited display capabilities may be equipped with better audio editing capabilities increasing their performance.

The present invention may be embodied in other specific forms without departing from its spirit or essential characteristics. The described embodiments are to be considered in all respects as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for editing an audio sequence, comprising the steps of:

storing said audio sequence in memory;

selecting a portion of said audio sequence, said selecting step being performed by a user, said selected portion being less than all of said audio sequence;

responsive to selecting of a portion of said audio sequence, distinguishing said selected portion of said audio sequence from the remainder of said audio sequence by automatically varying an audio characteristic of said selected portion of said audio sequence during playback to said user in a visual display challenged environment, wherein said distinguishing step does not permanently alter said audio characteristic of said selected portion; and performing an editing operation on said selected portion of said audio sequence responsive input from said user in said visual display challenged environment.

2. The method as recited in claim 1 wherein said audio characteristic is a pitch of said selected portion.

3. The method as recited in claim 2 wherein said step of distinguishing said selected portion of said audio sequence includes re-sampling said selected portion.

4. The method as recited in claim 1 wherein said step of performing an editing operation includes the step of removing said selected portion from said audio sequence.

5. The method as recited in claim 1 wherein said step of performing an editing operation includes the step of relocating said selected portion of said audio sequence from a first location to a second location in said audio sequence.

6. The method as recited in claim 1 wherein said step of selecting a portion of said audio sequence includes the step of utilizing start and end edit pointers.

7. A computer program product, comprising:

a computer-readable medium having stored thereon computer executable instructions for implementing a method for editing an audio sequence, said computer executable instructions when executed, perform the steps of:

storing said audio sequence in memory;

receiving input from a user selecting a portion of said audio sequence, said selected portion being less than all of said audio sequence;

responsive to receiving input from a user selecting of a portion of said audio sequence, distinguishing said selected portion of said audio sequence from the remainder of said audio sequence by automatically varying an audio characteristic of said selected portion of said audio sequence during playback to said user in a visual display challenged environment, wherein said distinguishing step does not permanently alter said audio characteristic of said selected portion; and performing an editing operation on said selected portion of said audio sequence responsive input from said user in said visual display challenged environment.

8. The computer program product as recited in claim 7 wherein said audio characteristic is a pitch of said selected portion.

9. The computer program product as recited in claim 8 wherein said step of distinguishing said selected portion of said audio sequence includes re-sampling said selected portion.

10. The computer program product as recited in claim 7 wherein said step of performing an editing operation includes the step of removing said selected portion from said audio sequence.

11. The computer program product as recited in claim 7 wherein said step of performing an editing operation includes the step of relocating said selected portion of said audio sequence from a first location to a second location in said audio sequence.

12. The computer program product as recited in claim 7 wherein said step of receiving input from a user selecting a portion of said audio sequence includes the step of utilizing start and end edit pointers.

13. An audio editing system, comprising:

a memory for storing an audio sequence;

a stored audio sequence memory address controller coupled to said memory;

an audio edit controller for receiving input from a user selecting a portion of said audio sequence for performing an editing operation, said selected portion being less than all of said audio sequence; and a timing controller coupled to said audio edit controller that, responsive to receiving input from a user selecting a portion of said audio sequence, automatically varies an audio characteristic of said selected portion of said audio sequence during playback to said user in a visual display challenged environment, wherein said timing controller does not permanently alter said audio characteristic of said selection portion.

14. The audio editing system as recited in claim 13 further comprising:

a digital to analog converter (D/A) for converting said stored audio sequence to an analog audio signal; and a speaker having an amplifier coupled to said D/A converter, wherein said speaker is utilized for broadcasting said analog audio signal.

15. The audio editing system as recited in claim 13 wherein said audio characteristic is a pitch of said selected portion of said audio sequence.

16. The audio editing system as recited in claim 15 wherein said timing controller varies said pitch of said selected portion by controlling a sampling rate of said audio sequence.

17. The audio editing system as recited in claim 13 wherein said stored audio sequence memory address controller is a counter.

18. The audio editing system as recited in claim 13 wherein said audio edit controller includes means for cutting, copying and pasting said audio sequence.

* * * * *